United States Patent [19]

Learnard

[11] 4,296,866

[45] Oct. 27, 1981

[54] ARTICLE DISPLAY STAND

[76] Inventor: Stanley J. Learnard, 12659 Willow Spring Ct., Herndon, Va. 22070

[21] Appl. No.: 27,385

[22] Filed: Apr. 5, 1979

[51] Int. Cl.[3] ..... A47F 5/01; A47F 5/02

[52] U.S. Cl. ..... 211/131; 211/163

[58] Field of Search ..... 211/131, 163, 129, 133, 211/181, 56

[56] References Cited

U.S. PATENT DOCUMENTS 2,065,845 12/1936 Weaver ..... 211/181 X 3,452,880 7/1969 Kovacik et al. ..... 211/131 X

*Primary Examiner*—Roy D. Frazier

*Assistant Examiner*—Robert W. Gibson, Jr.

*Attorney, Agent, or Firm*—Dennis H. Lambert

[57] ABSTRACT

A rotatable display stand is comprised of an assembly of stacked wire baskets held secured together in a frame and supported for rotation on a substantially vertical shaft, with the stacked baskets defining article supporting and display pockets. A pair of baskets stacked one on top of the other define a plurality of the pockets, and the bottom basket defines a bottom for each pocket, while the top basket defines side supports or divisions between the pockets. Back panels are held in the frame behind the pockets, so that the baskets and panels define relatively shallow pockets spaced around the outside of the stand. The assembly is rotatably supported on the shaft approximately midway between the top and bottom of the assembly, and each pair of baskets has a guide engaged with the shaft to stabilize the assembly. The assembly defines a self-storing shipping package when parts thereof are removed and reassembled in a shipping configuration, and a bulletin board may be attached to the stand without requiring separate fasteners. A modification of the stand is constructed as a bulletin board support.

12 Claims, 15 Drawing Figures

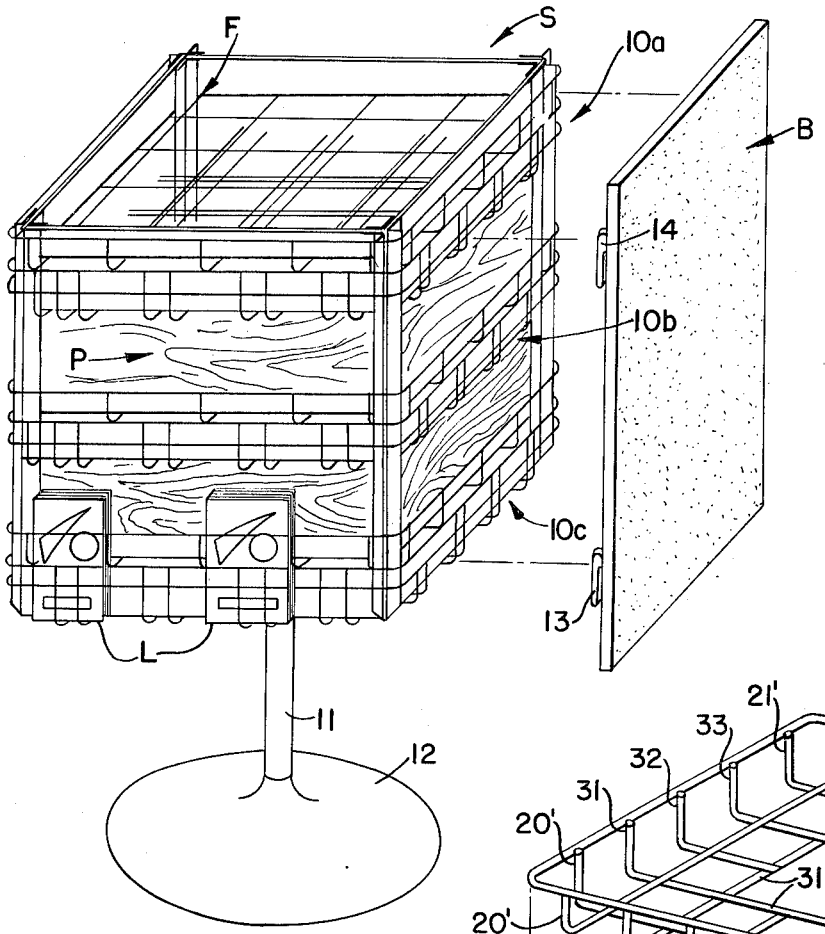
FIG. 1.
FIG. 2.
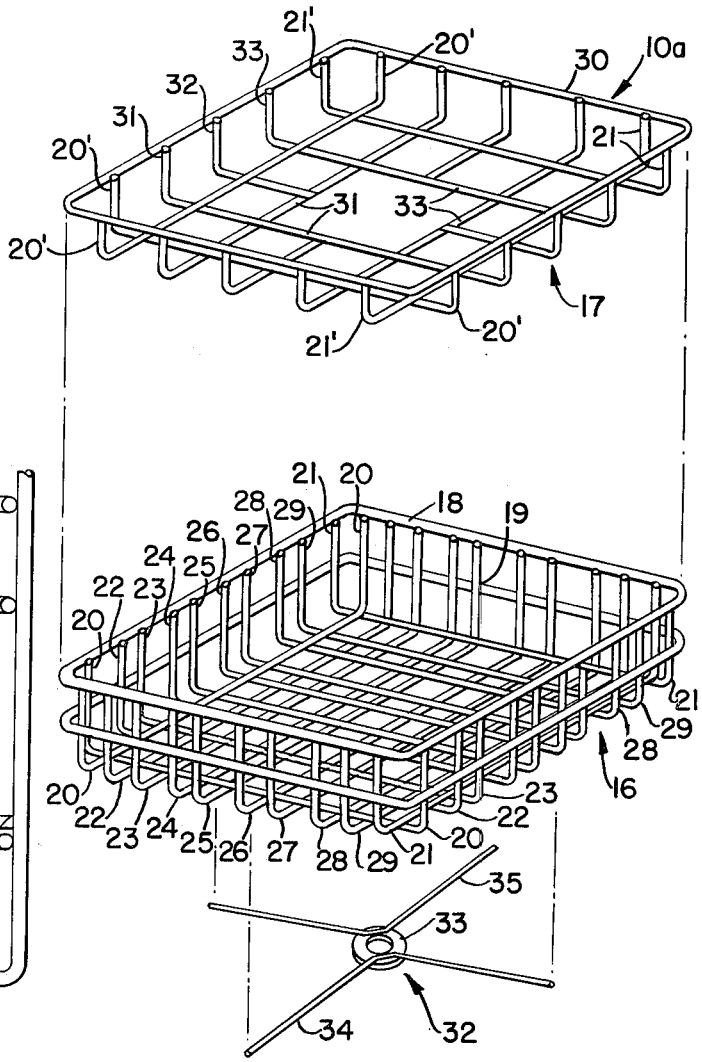
FIG. 3.
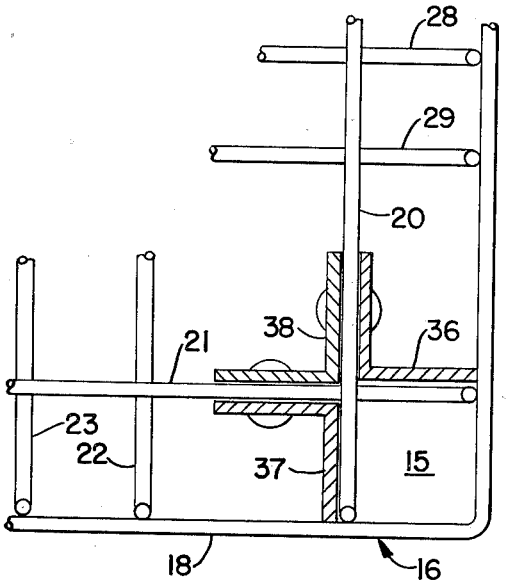

ARTICLE DISPLAY STAND

BACKGROUND OF THE INVENTION

This invention relates to display stands, and more particularly, to display stands for displaying articles such as pamphlets, advertising brochures, road maps, paperback books, and the like.

Many different types of stands for displaying such articles are known in the prior art, including both stationary racks or stands and rotatable racks or stands. Such racks or stands generally have means defining a plurality of pockets sized approximately to the articles to be supported therein. An example of a typical prior art rotatable article display stand is commonly located in drug stores, department stores and the like for supporting and displaying greeting cards.

Banks and similar businesses generally display various advertising brochures and literature explaining the banking services, but such materials are generally displayed in fixed display devices since most of the prior art devices are either unsuitable for use in banks and the like, because of their appearance or costs, or lack of adaptability to the limited number of brochures and the like generally displayed by banks. Moreover, it is sometimes desirable to provide a bulletin board or similar display surface in a bank lobby or the like, and most of the prior art display racks or stands do not lend themselves to use as bulletin boards or the like.

SUMMARY OF THE INVENTION

The present invention is a rotatable article display rack or stand which has a plurality of pockets on its outer surface for supporting and displaying brochures, pamphlets and the like. The display rack or stand of the invention is stable in use and is constructed such that it may readily be used as a bulletin board support or the like. Moreover, the appearance of the display rack or stand of the present invention is particularly suitable for use in bank lobbies or other similar locations and is readily adaptable to the needs of such businesses in that it may be used for supporting both bulletin boards and articles to be displayed with the relative portion of the device utilized for displaying articles limited to that needed to display the brochures and other literature of the particular business.

The present invention utilizes a plurality of pairs of stacked wire baskets which are interengaged and secured together in assembled relationship such that the baskets define a plurality of pockets with the lower basket in each pair supporting the bottom of an article to be displayed and the top basket in each pair providing divisions or side supports at the sides of adjacent pockets.

The stacked baskets are secured in a frame and are supported on a generally vertical shaft by means which effectively supports the assembly at approximately its mid height, thereby rendering the display rack of the present invention exceptionally stable in use.

Moreover, because of the unique construction of the display rack of the invention it is economical and durable and may be subjected to rough handling without causing damage thereto.

Additionally, the display rack of the invention may be partially disassembled and reassembled in a shipping configuration whereby the display rack forms a partially self-contained shipping package.

OBJECTS OF THE INVENTION

Accordingly, it is an object of this invention to provide an economical, durable article display rack wherein a plurality of like or dissimilar articles may be supported and displayed.

Another object of the invention is to provide a rotatable article display rack for displaying articles such as pamphlets, advertising literature, paperback books and the like, wherein a plurality of nested, wire baskets are provided to define the bottoms and side portions of pockets for holding the articles to be displayed.

A further object of the invention is to provide an article display stand comprising a plurality of nested together wire baskets rigidly held in assembled relationship by a frame and supported as an assembly on a generally vertical shaft with the support for the assembly being positioned approximately midway between the top and bottom of the assembly, thereby rendering the display rack stable in operation.

A still further object of the invention is to provide an article display rack or stand which may be simultaneously used to display articles such as greeting cards, advertising brochures and the like and to support a bulletin board thereon.

Yet a further object of the invention is to provide a frame of strong yet economical construction which includes means for quickly and easily mounting a plurality of bulletin boards thereon.

Another object of the invention is to provide a bulletin board stand which includes a rigid frame rotatably supported on a generally vertical shaft with a plurality of bulletin boards readily removably secured to the frame.

BRIEF DESCRIPTION OF THE DRAWINGS

FIG. 1 is an exploded perspective view of a display stand or rack in accordance with the invention showing a bulletin board removed from the display stand.

FIG. 2 is an enlarged perspective exploded view of a pair of the baskets used to form a plurality of article display pockets in the stand of FIG. 1.

FIG. 3 is a greatly enlarged fragmentary view in section looking down on one corner of the bottom basket in a pair of baskets forming pockets in the display stand of FIG. 1.

DETAILED DESCRIPTION OF THE PREFERRED EMBODIMENTS

Figure 4:
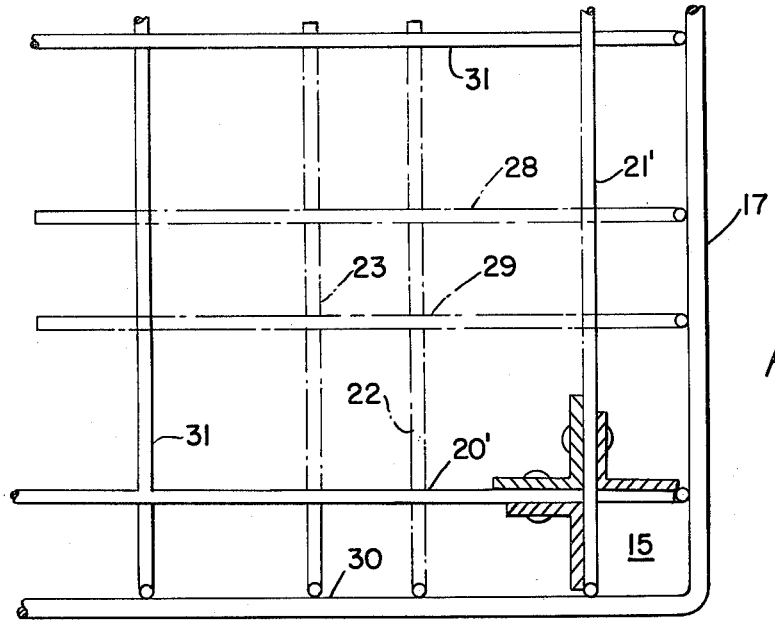
FIG. 4 is a view similar to FIG. 3, looking down on a top basket in the pair of baskets of FIGS. 1 and 2.

In the drawings, wherein like reference numerals indicate like parts throughout the several views, an article display stand S comprises first, second and third pairs 10*a*, 10*b* and 10*c*, of stacked wire baskets, and panels P rigidly secured to a supporting frame F to define a plurality of article supporting pockets wherein articles such as advertising literature and the like L may be supported. The assembly comprising the baskets, panels and frame is rotatably supported on an elongate, generally vertical shaft 11 supported, in turn, on a base 12.

The construction of the stand S is such that a bulletin board B may be readily applied to and removed from the stand, if desired, by inserting hooks 13 and 14 on the back of the bulletin board B into spaces 15 defined at the corners of the assembly (see FIG. 3).

The pairs 10*a*, 10*b* and 10*c* of stacked baskets are substantially identical in construction, and accordingly only one pair or assembly 10*a* of baskets will be described in detail with reference to FIGS. 2, 3 and 4. In these figures, the pair or assembly 10*a* comprises a bottom basket 16 and a top basket 17. The bottom basket 16 comprises a pair of perimeter wires 18 and 19 formed into substantially rectangularly shaped closed loops having four sides. Each side has a pair of corner wires 20 and 21 secured thereto, adjacent the juncture of two sides of the loop and extending downwardly from the top perimeter wire 18 past the bottom perimeter wire 19 and then bent horizontally and extending to the opposite side of the perimeter wires at which the corner wires extend upwardly past the bottom perimeter wire 19 to the top perimeter wire 18. A plurality of pairs of equidistantly spaced bottom support wires 22–23, 24–25, 26–27 and 28–29 are uniformly spaced along each of the sides and extend in generally parallel relationship to the corner wires 20, 21. The pairs of bottom support wires 22–23, etc., define bottom supports for articles placed in the pockets defined by the baskets.

The top basket 17 comprises a perimeter wire 30 formed in a closed loop having a generally rectangular shape with four sides and pairs of corner wires 20', 21', secured thereto adjacent the juncture of opposite sides of the loop and extending downwardly therefrom and thence substantially horizontally to the opposite side and thence upwardly to the perimeter wire. Three equidistantly spaced wires 31, 32 and 33 are joined to the sides of the loop between the corner wires 20' and 21' and these equidistantly spaced wires define divisions or side supports between the pockets defined by the wire baskets in the assembly of FIG. 1. As seen in FIG. 2, the center wire 32 is terminated at its juncture with the wire 31 extending transversely thereto such that the center of the top basket remains open.

Thus, when the two baskets 16 and 17 are nested together as in FIG. 1, the wires 31, 32 and 33 of the top basket comprise dividers or side supports for literaure L placed in the pockets defined by the baskets, and the wires 22–23, 24–25, 26–27 and 28–29 define bottom supports for the articles.

Figure 6:
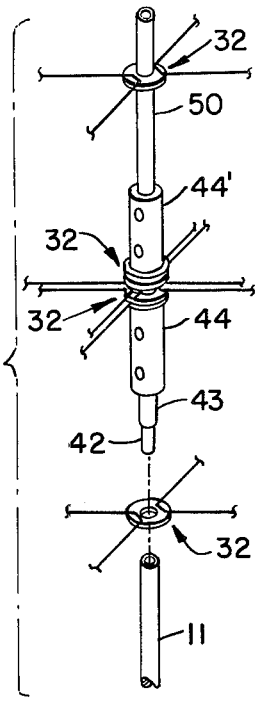
FIG. 6 is an exploded perspective view of the shaft and basket guides and supports used in the assembly of FIGS. 1 and 5.
Figure 5:
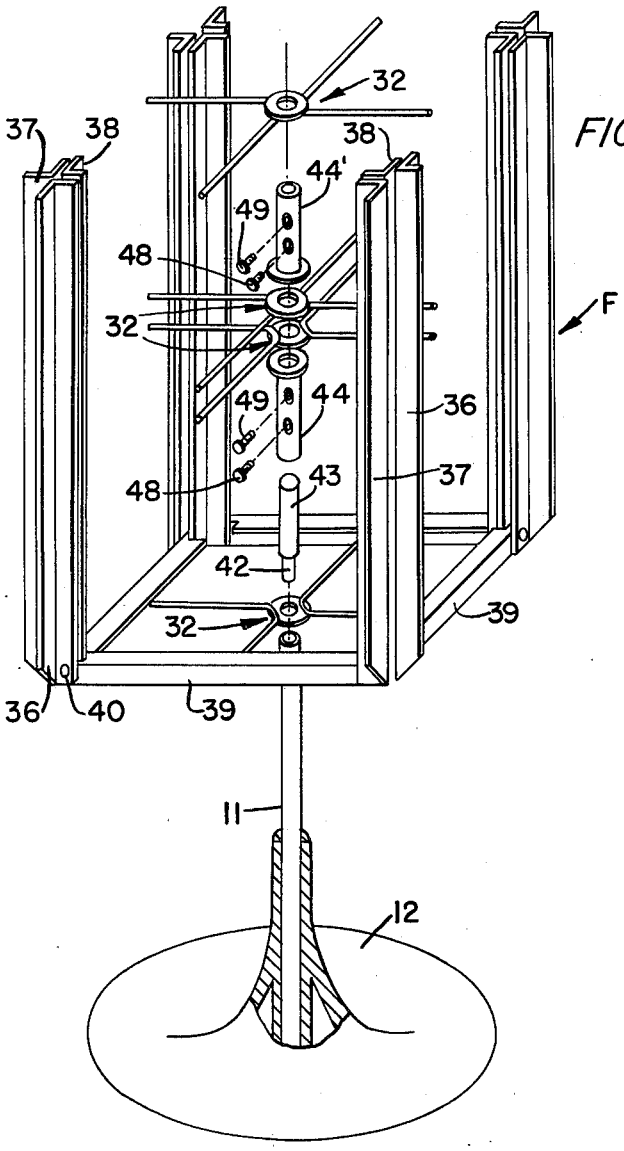
FIG. 5 is an exploded perspective view of the frame and guides used to secure the baskets together and support them on the shaft of the display stand.
Figure 7:
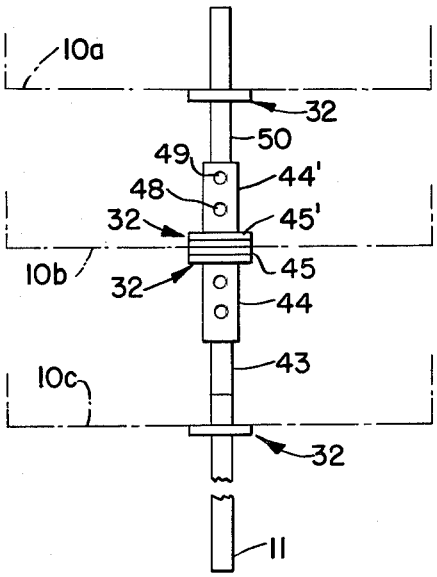
FIG. 7 is a somewhat diagrammatic view in elevation of the guides and support shaft used in connection with the baskets of the invention.
Figure 8:
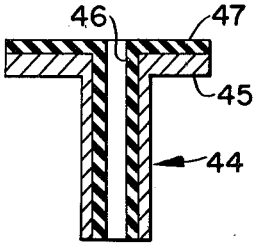
FIG. 8 is an enlarged view in vertical section of one of the guide sleeves used to support the basket assembly on the support shaft.
Figure 9:
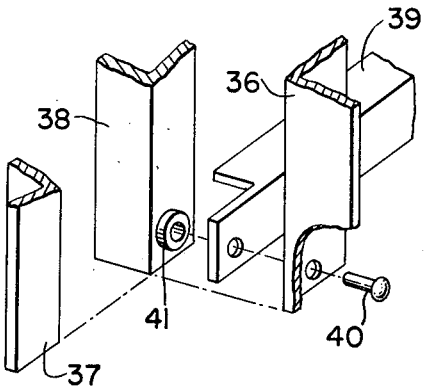
FIG. 9 is an enlarged fragmentary perspective exploded view of a bottom corner portion of the frame of the display stand of the invention.
Figure 10:
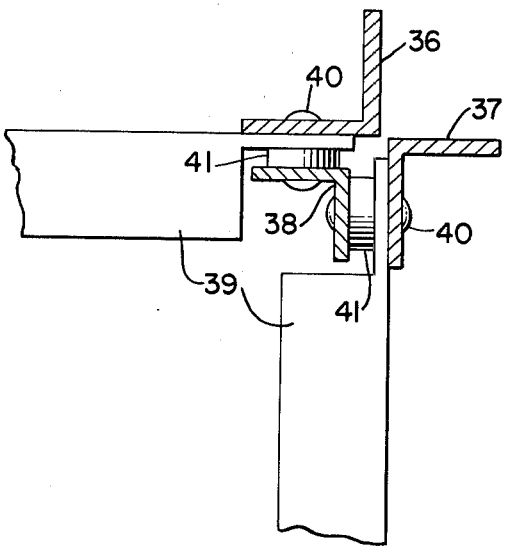
FIG. 10 is a fragmentary sectional view looking down on an assembled corner portion of the frame of the invention.
Figure 11:
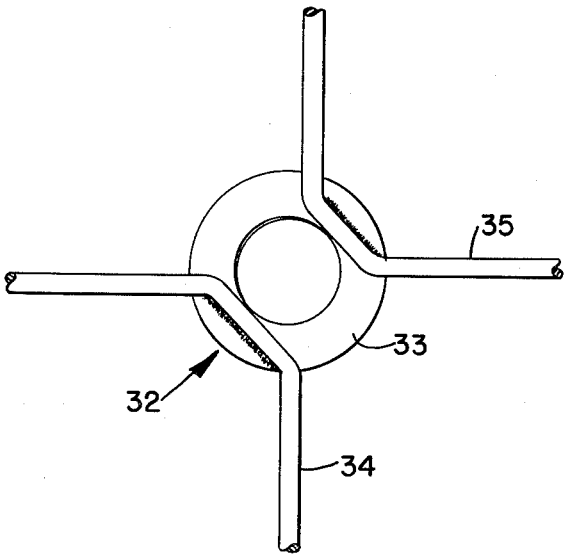
FIG. 11 is a greatly enlarged fragmentary plan view of one of the reinforcing guides used on the bottom basket of each pair of baskets in the assembly.

The wires of the wire baskets are welded together, as for example, by resistance welding, and a reinforcing anti-wobble guide 32 is welded to the underside of the bottom basket 16 in each basket assembly 10*a*, 10*b* and 10*c*. The anti-wobble guide 32 comprises a washer 33 which closely surrounds the shaft 11 and has a pair of brackes 34 and 35 welded thereto and welded to the underside of the bottom basket 16. As seen in FIGS. 5, 6 and 7, the middle basket assembly 10*b* has a washer and braces welded on both the top and bottom sides thereof.

The frame F which supports and rigidly secures together the baskets to form a unitary assembly, is seen best in FIGS. 5 through 10 and comprises a plurality of elongate upwardly extending angle members, with three angle members 36, 37 and 38 arranged substantially back-to-back at each corner of the frame F. A fourth angle member 39 extends between the bottoms of the corner assemblies 36, 37 and 38 and is secured at its opposite ends between adjacent walls or flanges of the angle members 36, 37 and 38 by means of a screw or rivet 40 or the like. A washer-like spacer 41 is engaged between the angle member 39 and angle member 38 to insure adequate clearance for the panels P and corner wires 20, 20' and 21, 21' of the baskets (see FIGS. 3, 4 and 10).

The anti-wobble guide structure and shaft support structure includes the elongate shaft 11 extending downwardly into the base 12 and projecting upwardly through the bottom anti-wobble washer 32 and into the upper end of which is received the reduced diameter end 42 of shaft section 43 which has its upper end secured in a tubular thrust sleeve 44 having a radially outwardly directed flange 45 on the upper end thereof and lined with a low friction plastic material or the like 46 which terminates in a plastic washer-like flange 47 on top of the flange 45 of the thrust sleeve 44. The shaft section 43 may be secured in the thrust sleeve 44 by any suitable means such as screws or rivets or the like 48 and 49.

In use, the bottom of the lower basket 16 in the middle basket assembly 10*b* is sandwiched between a pair of anti-wobble guides 32 and a second tubular thrust sleeve 44' is secured to a second shaft section 50 extending upwardly therefrom through the anti-wobble guide 32 secured to the bottom of the top basket assembly 10*a*.

Thus, the basket assembly is secured and supported on the shaft 11 at a point approximately midway between its top and bottom, and the support is accomplished via relatively low friction, smooth engagement between the anti-wobble guides 32 and plastic flanges 47 of thrust sleeves 44 and 44'.

Instead of the separate shaft sections 43 and 50, a single shaft section may be extended completely through the thrust sleeves and associated anti-wobble guides 32. In either this construction or that earlier described, the height of the basket assembly may be adjusted by changing the position of the thrust sleeves relative to the shaft section.

Figure 14:
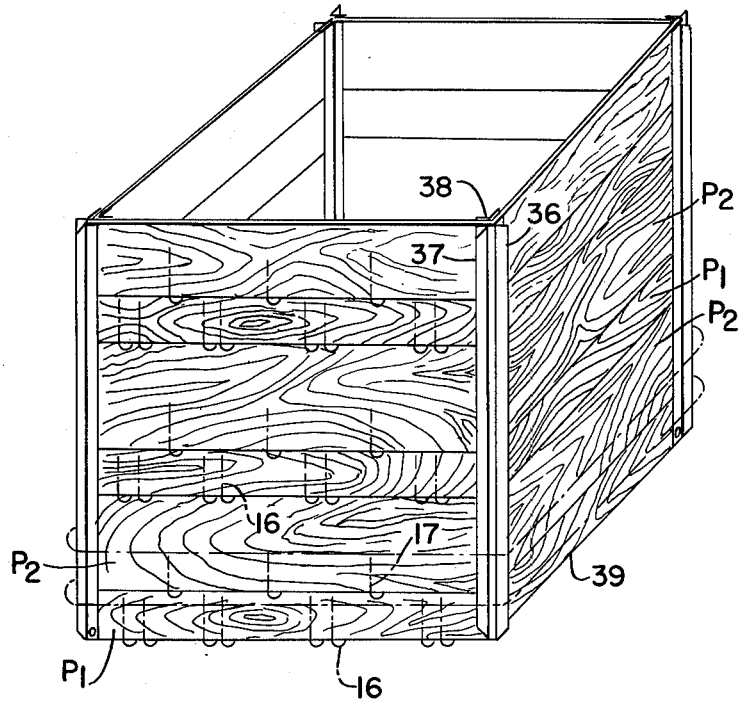
FIG. 14 is a fragmentary perspective view of the article supporting section of the display rack of the invention showing the back panels which define the rear of the pockets and showing portions of the wire basket assemblies in dot-and-dash lines.

As seen best in FIGS. 1 and 14, the spacing between adjacent basket assemblies 10*a*, 10*b* and 10*c* is accomplished by means of the panels or panel sections P which have a predetermined width to space the basket assemblies apart a desired distance. For example, as seen in FIG. 14, the bottom basket 16 of bottom basket assembly 10*c* is placed in the frame F with the corner wires 20 and 21 extending between the spaced apart angle members 36, 37 and 38 (FIGS. 3 and 4) and a first panel strip P1 is then inserted between the same frame members with its bottom edge resting on top of the horizontally extending wires of the bottom basket member 16. Thereafter, the top basket 17 is inserted into the frame by positioning the corner wires 20' and 21' between the angle members 36, 37 and 38 (see FIG. 4) and thereafter, a second panel member P2 of substantially greater width than panel member P1 is inserted between the angle members at its opposite ends and is disposed with its bottom edge on top of the horizontal wires of top basket 17. The bottom basket 16 of the middle basket assembly 10*b* is then inserted into the frame with the horizontal wires thereof resting on the top edge of panel member or members P2 and subsequent basket assemblies and panel members are positioned and supported in the frame in a corresponding manner until the desired number of basket assemblies is placed.

If desired, the bulletin board B may be removably attached to the display stand by inserting the hooks 13 and 14 on the back of the bulletin board downwardly into the spaces 15 defined by the basket and frame assembly.

Figure 12:
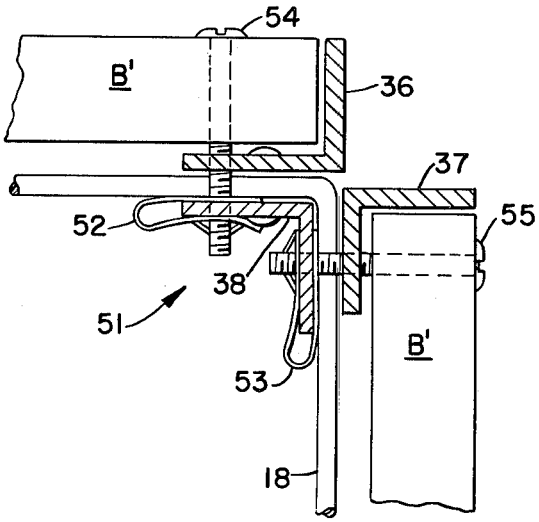
FIG. 12 is a fragmentary view in section looking down on one of the corners of a bulletin board support rack in accordance with the teachings of the invention.
Figure 13:
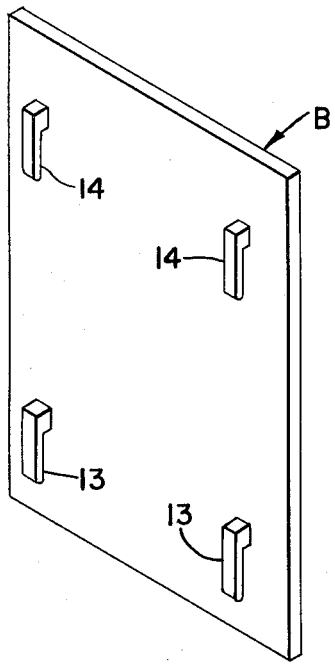
FIG. 13 is a perspective view looking toward the back of a bulletin board for use with the display rack of FIG. 1.

The concept of the present invention, i.e., a rigid unitary structure comprising a frame with wire baskets secured thereto, may be used for constructing a bulletin board support as indicated generally at 51, in FIG. 12. In this construction, the perimeter wire 18 (and perimeter wires 19 and 30) of the baskets is received in the space between the adjacent angle members 36, 37 and 38, and spring clips 52 and 53 are secured to the oppositely extending flanges of angle member 38 for receiving screws 54 and 55 extended through the edge of bulletin boards B' and through aligned openings in the flanges of angle members 36, 37 and 38, and thence through the spring clips 52 and 53.

Figure 15:
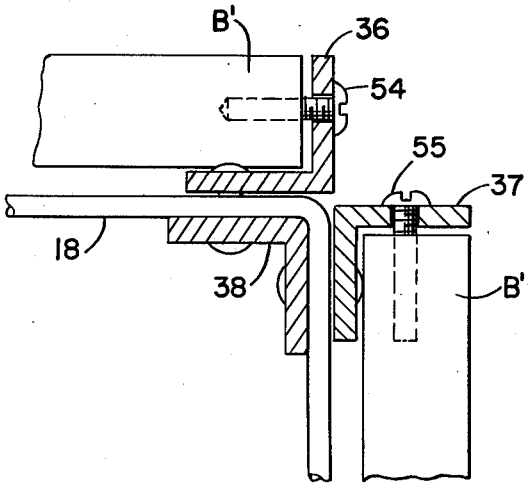
FIG. 15 is a view similar to FIG. 12, of a modified means of securing bulletin boards to a bulletin board supporting frame.

Alternatively, the assembly may be used to support bulletin boards in the manner illustrated in FIG. 15, wherein screws 54 and 55 are extended inwardly through the other flanges of angle members 36 and 37 and into the end edges of the bulletin boards B'.

Screws or rivets and the like may be extended through the flanges of the angle members 36, 37 and 38, and through adjacent end portions of panel members P1 and P2, to rigidly secure the basket assemblies, panel members and frame together.

In a typical display stand constructed in accordance with the invention, the perimeter wires 18, 19 and 30 are seven gauge wires while the remaining wires in each of the baskets are twelve gauge wires. Further, the display stand is approximately 20⅜ inches wide on each side thereof, and the shaft 11 has a one inch outside diameter. The angles 36, 37 and 38 are preferably ¾×¾×1/16 inch aluminum, and the bottom angles 39 are preferably ½×½×1/16 inch aluminum angles. Panels P1 preferably have a depth of 3½ inches and panels P2 a width or depth of 5½ inches. Moreover, the width of each pocket formed by the basket assemblies, i.e., the distance between wires 31, 32 and 33 is approximately 4.3 inches and the distance between the bottom support wires 22, 23 and 24, 25, etc., is approximately 1.33 inches.

As this invention may be embodied in several forms without departing from the spirit or essential characteristics thereof, the present embodiment is, therefore, illustrative and not restrictive, since the scope of the invention is defined by the appended claims rather than by the description preceeding them, and all changes that fall within the metes and bounds of the claims or that form their functional as well as conjointly cooperative equivalents are, therefore, intended to be embraced by those claims.

We claim:

1. An article display stand, comprising: a frame; and a plurality of pairs of stacked wire baskets supported on the frame, with each pair including a top basket and a bottom basket, the top basket including first wires spaced apart a first distance, and the bottom basket including second wires spaced apart a second distance less than the first distance, and the wires of both baskets of each pair defining a plurality of article supporting and display pockets wherein the first wires of the top basket define side supports for the articles in the pockets and the second wires of the bottom basket define bottom supports for the articles in the pockets.

2. An article display stand as in claim 1, wherein: the frame and baskets are rotatably supported on a substantially vertical shaft.

3. An article display stand as in claim 2, wherein: the frame and baskets define a generally cubical-shaped structure, with spaces or pockets at the corners thereof; and a bulletin board has support hooks thereon engaged in the spaces, supporting the bulletin board on the stand.

4. An article display stand as in claim 2, wherein: the frame and baskets define a generally cubical-shaped structure; and the frame comprises a basket engaging and supporting frame means at each corner of the stand extending substantially over the height of the assembled baskets, and a laterally extending frame means connected to and extending between the lower ends of the basket engaging and supporting frame means at the corners of the stand.

5. An article display stand as in claim 4, wherein: the baskets are substantially rectangularly shaped in plan view and have perimeter wires extending circumferentially therearound, and corner wires joined to the perimeter wires adjacent the corners of the basket; said frame means at the corners of the stand each including a plurality of elongate angle members arranged parallel to one another and defining spaces therebetween in which the corner wires of the baskets are received and secured.

6. An article display stand as in claim 5, wherein: panels are secured at their opposite ends to the frame means at the corners of the stand, defining backs for the pockets formed by the wire baskets.

7. An article display stand as in claim 6, wherein: anti-wobble guides are carried by each pair of baskets, and said anti-wobble guides engage the shaft.

8. An article display stand as in claim 7, wherein: the frame, baskets and panels comprise an assembly which is supported on said shaft for rotation relative thereto; and thrust sleeves are fixed to the shaft at a location to engage anti-wobble guide means on the pair of baskets at approximately the middle of the assembly, to support the assembly on the shaft against displacement in a direction longitudinally of the shaft.

9. An article display stand as in claim 4, wherein: the frame means at the corners of the stand each comprise a plurality of elongate angle members, with two of the angle members at each corner arranged to have a flange of each thereof projecting outwardly substantially perpendicularly to its associated side of the stand; and a bulletin board is secured to the angle members by means of a screw extended through an adjacent edge of the bulletin board and the flanges of the respective angle members.

10. An article display stand as in claim 6, wherein: the panels comprise strips having predetermined widths, and the width of the panel strips between adjacent baskets determines the vertical spacing between the baskets.

11. An article display stand, comprising: an assembly of wire baskets arranged one above the other and defining a plurality of pockets for supporting and displaying articles; a support shaft engaged with the baskets, supporting them for rotation together as a unit; and a plurality of elongate bars extending substantially the length of the assembly of baskets having an angle shape in transverse cross section and disposed generally back-to-back with a space therebetween, pairs of intersecting wires in said baskets being received and secured in the space between the bars, whereby the bars tie the assembly of baskets together for rotation as a unit.

12. An article display stand comprising: a plurality of superposed wire baskets arranged in spaced apart relationship and defining a plurality of article supporting pockets; a frame engaged with said baskets, securing them together as a unitary assembly; and panel means secured in the frame means between the superposed baskets and defining backs for the pockets while at the same time serving to space the baskets apart.

* * * * *